United States Patent [19]

Brouwer et al.

[11] 4,415,302

[45] Nov. 15, 1983

[54] PALLET RETRIEVING MECHANISM FOR FORKLIFT VEHICLE

[75] Inventors: Gerardus J. Brouwer, Keswick; William T. Arnold, Sutton West, both of Canada

[73] Assignee: Brouwer Turf Equipment Limited, Toronto, Canada

[21] Appl. No.: 296,921

[22] Filed: Aug. 27, 1981

[51] Int. Cl.[3] ..... B66F 9/10; B66F 9/19

[52] U.S. Cl. ..... 414/417; 414/664; 414/631; 414/661

[58] Field of Search ..... 414/661, 631, 662, 663, 414/664, 668, 495, 417, 785, 422, 424, 427, 648, 649, 659, 619, 647

[56] References Cited

U.S. PATENT DOCUMENTS

| | | | |
|---|---|---|---|
| 2,256,453 | 9/1941 | Bomar | 414/417 |
| 2,619,241 | 11/1952 | Jessen | 414/417 |
| 2,707,573 | 5/1955 | Balwics | 414/608 |
| 4,274,794 | 6/1981 | Olson | 414/663 |

FOREIGN PATENT DOCUMENTS

| | | | |
|---|---|---|---|
| 1093566 | 11/1953 | France | 414/664 |
| 1568365 | 5/1969 | France | 414/664 |

*Primary Examiner*—Robert B. Reeves
*Assistant Examiner*—James Barlow
*Attorney, Agent, or Firm*—Rogers, Bereskin & Parr

[57] ABSTRACT

A forklift vehicle has hooks mounted on the forks for preventing removal of a loaded pallet from the forks and a gate for ejecting the contents of the pallet as the forks are withdrawn. The hooks are normally biased out of engagement with the pallet but a cam mechanism moves the hooks into pallet engaging position when the forks are moved to a selected unloading height. The gate is mounted on the rear of the forks and is biased there by two pairs of extensible links. During unloading the forks are moved forwardly and downwardly to bring the gate in front of a pair of stops. The forks are then moved rearwardly, withdrawing the pallet while the gate ejects the pallet contents. The forks are then raised above the stops, allowing the biased links to return the gate to its rear position.

4 Claims, 7 Drawing Figures

PALLET RETRIEVING MECHANISM FOR FORKLIFT VEHICLE

This invention relates to a forklift vehicle having means for retrieving a pallet.

Forklift vehicles are commonly used for transporting pallets carrying loads. Ultimately, the load on the pallet must be removed. In the case of bulky but delicate loads such as rolls of cut sod, the removal of the pallet contents can be laborious and expensive since each roll of sod must be removed by hand and restacked on the ground.

In our co-pending patent application Ser. No. 330,326, a forklift vehicle is shown in which the fork carriage is movable forwardly and rearwardly and in which a gate is provided to block the contents of the pallet as the forks are withdrawn rearwardly. By use of this mechanism, the pallet can effectively be withdrawn rearwardly from beneath its contents, thereby depositing its contents onto the ground. The discharge procedure is such that the pallet contents have a vertical movement only, without horizontal movement, thereby minimizing damage to the contents.

The present invention provides certain improvements to the aforementioned mechanism. In one aspect the present invention provides: in a forklift vehicle, said vehicle having a fork tower, forks mounted on said tower for carrying a pallet, and means for raising and lowering said forks on said tower, the improvement comprising hook means mounted on said forks and adapted to engage said pallet; means mounting said hook means for movement between a first position in which said hook means engage said pallet to prevent movement of said pallet off said forks, and a second position in which said hook means are disengaged from said pallet to permit movement of said pallet off said forks; and hook actuating means including cooperating cam and cam follower means mounted on said hook means and on said fork tower for moving said hook means to said first position when said forks are at a first height above the ground and for moving said hook means to said second position when said forks are at a second height above the ground, said first and second heights being different.

In another aspect the present invention provides: a pair of forks facing in a predetermined direction for supporting a loaded pallet, blocking means operable for blocking the contents of said pallet from moving in a second direction 180 degrees opposed to said predetermined direction, and means operable for withdrawing said pallet in said second direction while said contents thereof are blocked from moving in said second direction, thereby removing said pallet from beneath said contents and hence discharging said contents from said pallet, said blocking means comprising a gate, link means pivotally connected between said forks and said gate and extensible between a first folded position in which said gate is supported by said link means over the rear of said forks and a second extended position in which said gate is supported by said link means over the fronts of said forks, and means biasing said link means to said first position.

Further objects and advantages of the invention will appear from the following description, taken together with the accompanying drawings in which.

Figure 1:
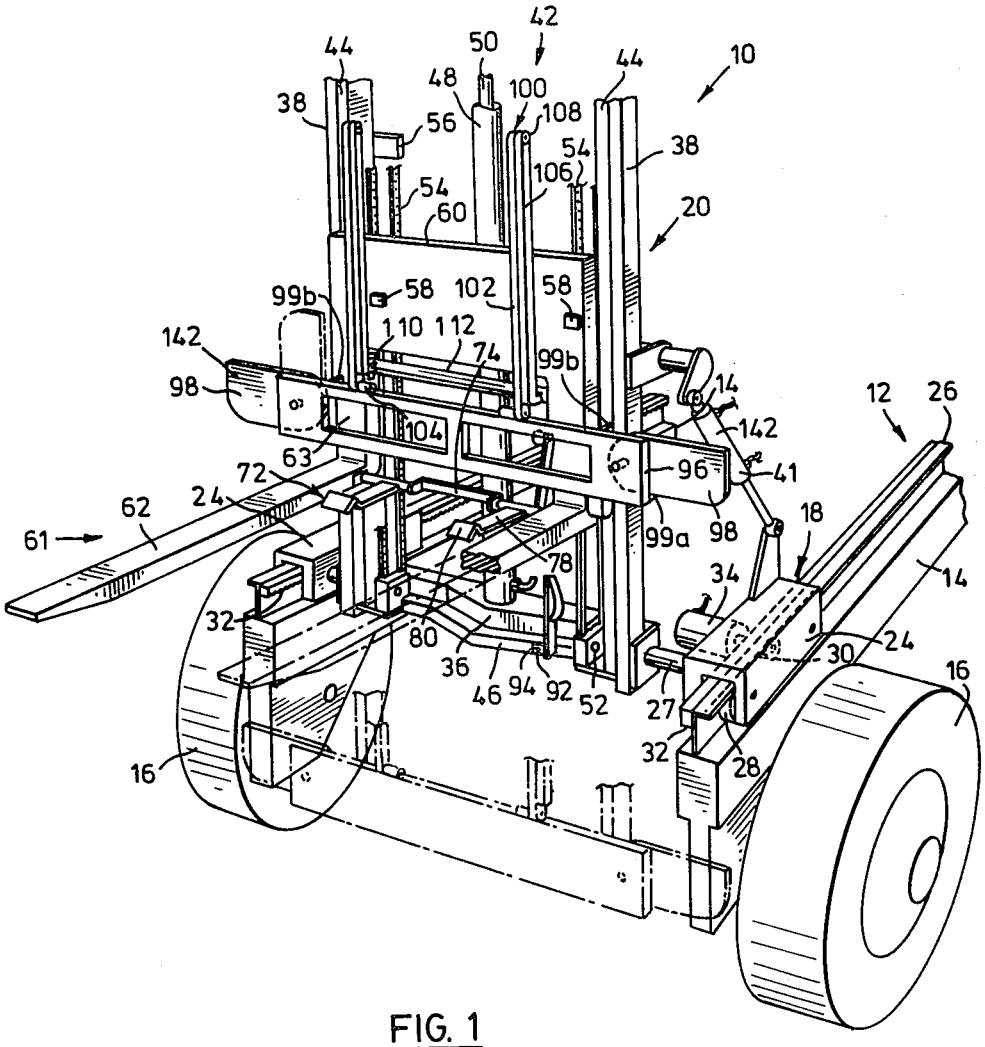
FIG. 1 is a front perspective view showing a portion of a forklift vehicle having a pallet retrieving mechanism of the invention.
Figure 2:
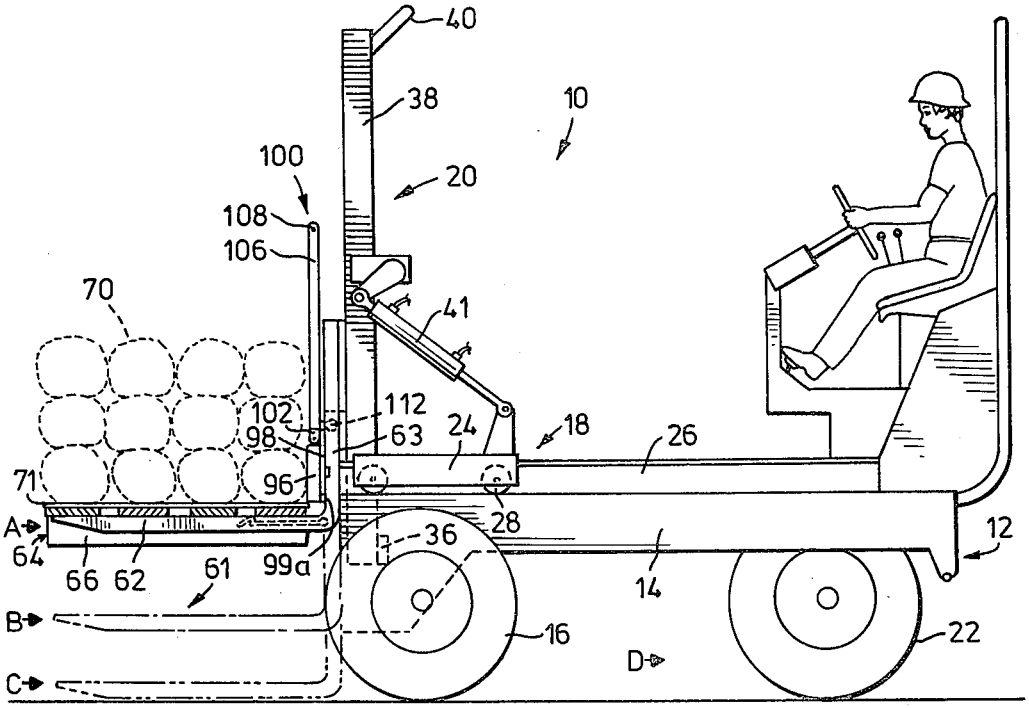
FIG. 2 is a side view of the vehicle of FIG. 1, showing the forks at different heights.

Reference is first made to FIGS. 1 and 2, which show a typical forklift vehicle 10 with which the invention may be used. The forklift vehicle 10 is the same as that described and shown in our said copending patent application. Since the vehicle itself does not form part of the invention, it will be described only briefly.

As shown, the forklift vehicle 10 includes a frame 12 formed by a pair of elongated, parallel, laterally spaced longitudinal frame members 14 connected together at their rear by transverse frame members not shown. Each frame member 14 has near its front a front wheel 16 located on the outside thereof, leaving the space between the frame members 14 clear for a fork carriage 18 and fork tower 20. The rear of the vehicle is supported by rear steering and driving wheels 22 (FIG. 2).

The fork carriage 18 comprises a pair of carriage side members 24, each movable forwardly and rearwardly along a rail 26 located atop and forming part of side frame member 14. The carriage side members 24 are joined by a transverse tube 27 and are supported and guided on the rails 26 by rollers, one of which is shown at 28, and by side thrust rollers not shown. The carriage side members 24 are driven along the rails by a drive pinion 30 which engages the teeth of a rack 32 located on the underside of the inner surface of the rail 26. A hydraulic motor 34 provides power for the pinion 30.

The fork tower 20 includes a base 36 which is pivotally and slidably mounted on the transverse tube 27. The fork tower 20 also includes a pair of vertically oriented, laterally spaced tower channels 38 which face inwardly towards each other and which are welded at their bottoms to the base 36. The tops of the channels 38 are connected by a U-shaped tube 40 (FIG. 2) which holds them in proper spaced relation.

Since the fork tower base 36 is pivotally mounted on tube 27, the fork tower 20 can tilt in an arc extending forwardly and rearwardly, the tilting being controlled by a pair of cylinders, one of which is shown at 41 in FIG. 1. Cylinder 41 and its piston rod are connected between fork tower channel 38 and carriage side member 24.

The fork tower 20 further includes a conventional mast 42 formed by a pair of side channels 44 connected together by a bottom cross member 46 and by a top cross member not shown. The mast 42 is raised and lowered by a conventional vertically oriented cylinder 48 secured to the base 36 and having a piston rod 50 extending upwardly and secured to the top cross member of the mast (not shown). The outwardly opposed surfaces of the mast side channels 44 carry rollers (not shown) to guide the mast in the tower channels 38 as the mast moves up and down.

At each side thereof the mast 42 carries lower sprockets 52 and upper sprockets (not shown). Chains 54 extend around these sprockets and are at their rear runs secured to brackets 56 welded to the tower channels 38. At their front runs the chains 54 are secured to conventional blocks 58 which in turn are welded to the rear plate 60 of a set of forks generally indicated at 61. Thus, as the piston rod 50 of the mast cylinder 48 is extended, the forks 61 will rise in conventional manner at twice the rate of such extension. Similarly, as the piston rod 50 is retracted, the forks 61 will be lowered in conventional manner at twice the rate of the retraction.

In FIGS. 2 through 5 the forks 61 are shown as including a set of forwardly extending tines 62 having rear upward extensions 63 joined to the rear plate 60. The tines 62 are shown as carrying a conventional pallet 64. The pallet 64 is formed from longitudinal rails 66 and a set of transverse boards 68 secured to the tops of the rails 66. The pallet 64 carries a load shown as rolls of sod 70, placed on a sheet 71 of smooth material such as plastic, steel or plywood sheeting.

For withdrawal of the pallet 64 from beneath its load 70, means must be provided to grip the pallet. These means, shown in FIGS. 1 through 5, comprise a hook mechanism generally indicated at 72. The hook mechanism 72 includes a cross shaft 74 (FIG. 1) extending between the rear ends of the fork tines 62 and pivotally journaled therein. A hook 76 extends forwardly from the cross shaft 74 adjacent each end thereof, each hook 76 comprising a body member 78 and a front upwardly projecting barb 80. A pair of hook limit stops 82, 84 (FIG. 3) extend from the side of one fork tine 62 and protrude over and under the hook body member 78, to limit the upward and downward movement of the hooks.

Fixed to and extending rearwardly and upwardly from the cross shaft 74 is a cam follower support member 86 which carries a cam follower roller 88. Roller 88 is positioned to engage the rearwardly facing surface of a cam track 90. Track 90 is welded to a flange 92 which in turn is secured by bolt 94 to the lower cross member 46 of the mast.

The operation of the hook mechanism described is as follows. When the forks are in the raised condition shown at A in FIG. 2, the cam follower roller 88 (FIG. 3) is located well above and therefore out of engagement with the cam track 90. The weight of the hooks 76, which are formed of relatively heavy metal, maintains the hooks in their lowered position against lower stop 84, the barbs 80 being out of engagement with the pallet cross members 68, as shown in dotted lines in FIG. 2. The forks 61 can thus be used to pick up and disengage from pallets on elevated surfaces, without the hook mechanism being operative.

Figure 3:
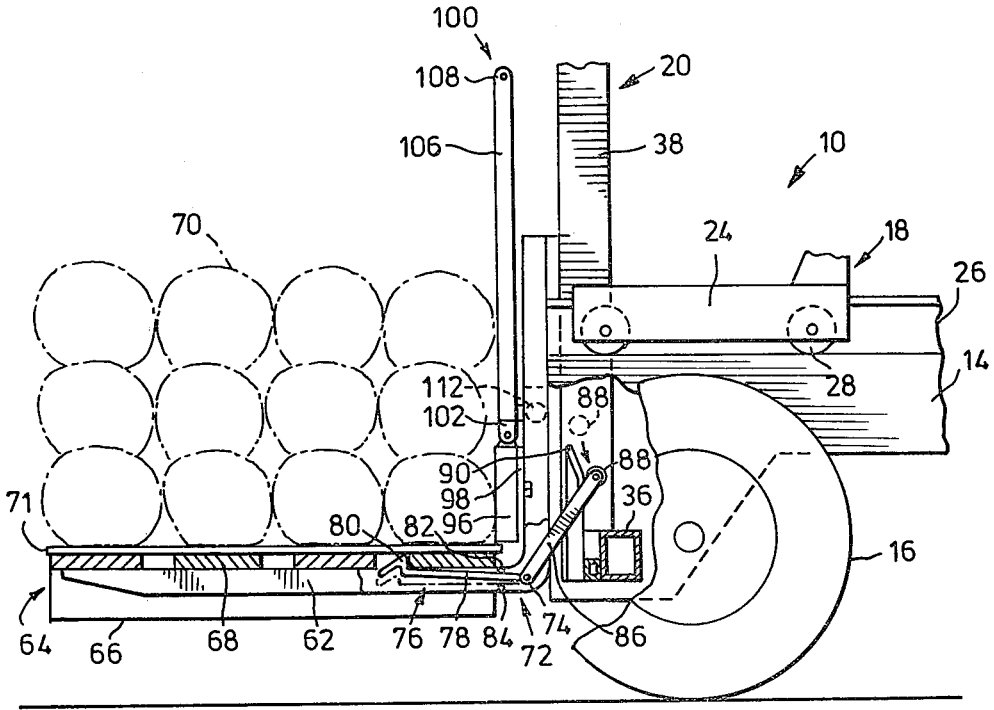
FIG. 3 is a side view of a portion of the vehicle of FIG. 1, showing the pallet engaging hooks in engaged and disengaged position.

Position B shown in dotted lines in FIG. 2 is the pallet retrieving position of the forks. When the forks are lowered to this position, as also shown in FIG. 3, the fork rear plate 60 moves downwardly at twice the rate of the mast 42, and at position B the cam follower roller 88 engages the cam track 90, forcing the roller 88 rearwardly and downwardly. This rotates the hooks clockwise, moving the barbs 80 into the space between the pallet cross members 68. The contents of the pallet can now be ejected onto the ground while the hooks 76 prevent removal of the pallet from the forks 61, as will be described shortly.

Figure 6:
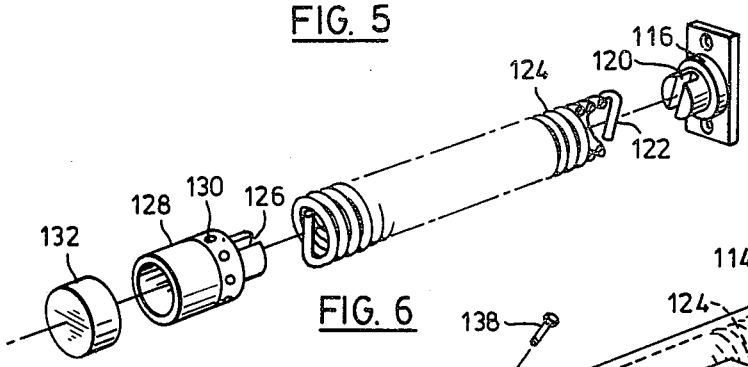
FIG. 6 is a perspective exploded view of the biasing mechanism for the gate linkage.

For removal of the pallet 64 from the forks, the forks are lowered further to position C shown in FIG. 2 and also in FIG. 6. In this position, the cam roller 88 moves below the cam track 90, allowing gravity to cause the hooks 76 to pivot counterclockwise, bringing the barbs 80 below the pallet cross members 68. The forks can now be lowered further and withdrawn from the pallet.

Typically position B, in which the hooks 76 are raised, occupies a height range in which the top surfaces of the fork tines 62 at the backs of the tines are between 8 inches and 5 inches above the ground. If the top surfaces of the fork tines at their backs are more than 8 inches or less than 5 inches above the ground, the hooks are not raised and will not interfere with pallet removal. If it is desired to have the hooks inoperative at all times, the cam track 90 can be removed by removal of the single bolt 94, in which case the hooks 76 will remain permanently against lower stop 84.

The gate mechanism for discharging the contents of a pallet will next be described. As shown in FIG. 1, there is provided a transverse gate 96 having a pair of extension wings 98 pivotally connected one to each outer end thereof. The full line position of the wings 98 is their position when used to eject the contents of a pallet; the dotted line position shown for one of the wings 98 in FIG. 1 shows their position when not in use. The wings 98 are prevented from falling below their extended positions shown in FIG. 1 by small stop pins **99*a* welded to and projecting rearwardly from the lower outer edges of gate 96, and are prevented from falling inwardly past the dotted line position by similar upper stop pins 99*b***.

The gate 98 is supported on the forks 61 by two pairs of links 100. Each pair of links 100 includes a first link 102 which is pivotally connected at 104 to the top of the gate 96 and normally extends vertically upwardly therefrom, and a second link 106, the tops of the two links being pivotally connected together at 108. The second link 106 normally extends vertically downwardly beside the first link 102 and has at its bottom an integral rearwardly extending short projection 110 which is fixed to a cross tube 112. The cross tube 112 extends between and is pivotally journaled in the rear upward extensions 63 of the forks. The cross tube 112 is biased in a clockwise direction as shown in FIGS. 1 and 2 in order to maintain the links 100 in the vertical orientation shown in FIGS. 1 and 2, with the gate 96 held against the rear upward extensions 63 of the forks. This is the orientation which prevails when the gate 96 is not in use. The biasing of the cross tube 112 is much like that of a window blind and is shown in detail in FIGS. 6 and 7.

Figure 7:
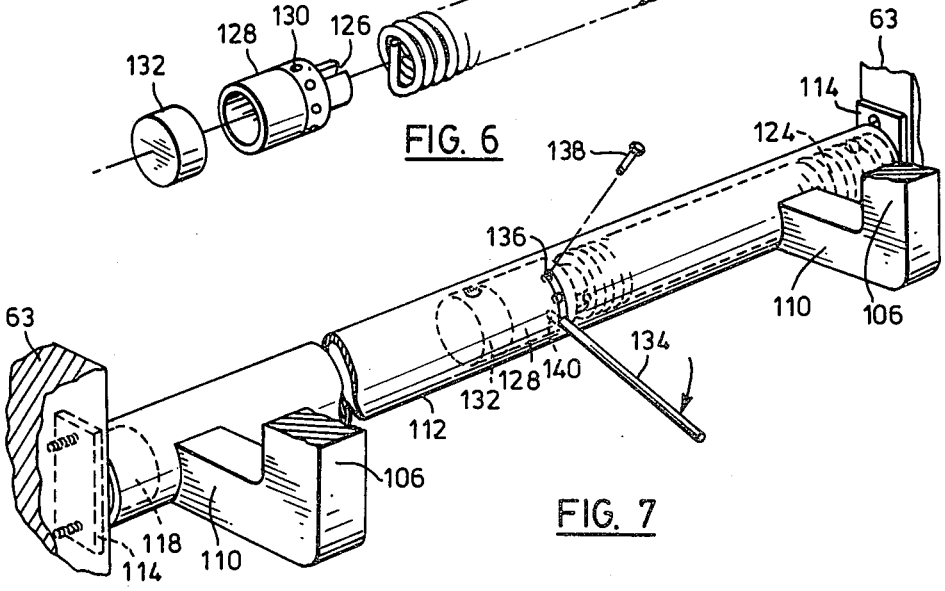
FIG. 7 is a perspective view showing the cross shaft, with the biasing mechanism therein, for the gate linkage.

As shown in FIGS. 6 and 7, opposed anchor plates 114 are fixed one to each upwardly extending fork rear upward extension 63, and the cross tube 112 is pivotally journaled over bushings 116, 118 one fixed to each anchor plate. The bushing 116 contains a slot 120 therein to accommodate one end 122 of a tightly coiled spring 124. The other end of the coil spring 124 is located in the slot 126 of an adjustable "nut" 128 having positioning holes 130 spaced around its circumference. The adjustable nut 130 bears against a positioning stop 132 welded to the inside of the cross tube 112.

To tension the spring 124, a torque adjusting rod 134 is inserted through a slot 136 in the cross tube 112 into one of the positioning holes 130 and is moved clockwise as shown in FIG. 7 to the end of the slot 136. The process is then repeated using another torque adjusting rod 134 (so that when one rod is removed the other will be in position) until the desired spring tension is achieved. A fixing pin 138 is then pushed into the most counterclockwise hole 140 in the slot 136 to prevent unwinding of the spring 124.

The operation of the gate mechanism shown is as follows. When it is desired to eject the contents 70 of a pallet 64 onto the ground, the fork carriage 18 is moved to its most forward position, as shown in FIG. 2, so that the gate 96 is located forwardly of the front ends of the main frame members 14. The wings 98 are then folded outwardly as shown in FIG. 1 and the forks 61 are lowered to position B in FIG. 2. In this position the gate 96 has the dotted line position shown in FIG. 1. Preferably the fork tower 20 is tilted forwardly at this time, using tilt cylinder 41, so that the tips of the fork tines 62 touch or nearly touch the ground. In fact, when the pallet contents are being unloaded and when the ground is soft, the fork tower 20 is typically tilted sufficiently that the front edges of the pallet rails 66 dig into the ground and the top of the front edge of the front board 68 is flush with the ground. Thus, the pallet contents are not dropped when they are discharged.

Figure 4:
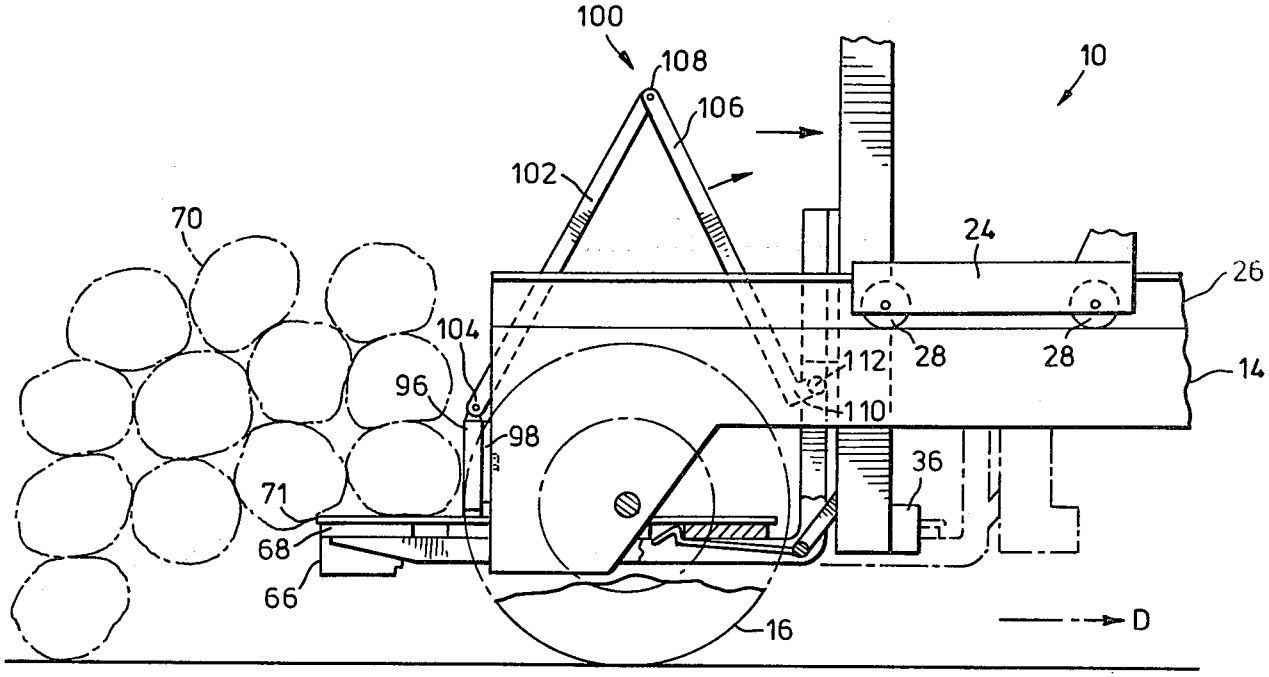
FIG. 4 is a side view similar to that of FIG. 3 but showing the load on the pallet being discharged and the pallet being retrieved; and the pallet being retrieved.
Figure 5:
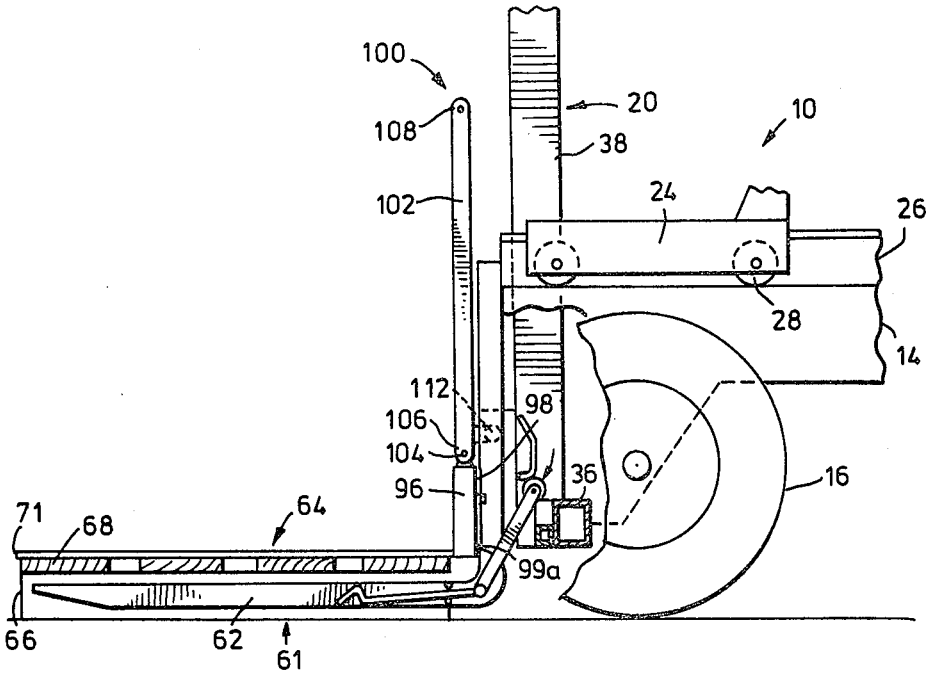
FIG. 5 is a side view similar to that of FIG. 3 but showing the pallet lowered to the ground and the hooks disengaged.

The fork carriage 18 is now moved rearwardly, withdrawing the pallet 64 in the direction of arrow D, FIGS. 2 and 4. Since rearward movement of the gate 96 is blocked by the front of the frame members 14, the gate 96 acts to force the contents 70 of the pallet 64 off the pallet and onto the ground. The barbs 80 of the hooks 76 engage the pallet at this time, preventing the pallet from disengaging from the fork tines 62. The plastic sheet 71 prevents the pallet cross members from catching the pallet contents.

As the fork carriage 18 and pallet 64 are moved rearwardly, the cross tube 112 (FIG. 4) rotates counterclockwise and the links 100 extend, permitting the relative movement shown between the gate 96 and the fork carriage 18. Since the movement of the pallet contents onto the ground is essentially a vertical movement, with little or no horizontal movement, damage to the contents of the pallet is minimized.

When the pallet 64 is fully withdrawn in the direction of arrow D past gate 96, the contents of the pallet have been completely discharged. The gate 96 can now be returned to its normal position shown in FIG. 3 simply by raising the forks. As the gate 96 is raised above the frame members 14, the clockwise bias of cross shaft 112 returns the links 100 to folded vertical position, carrying the gate 96 rearwardly to its FIG. 3 position. The wings 98 may be folded upwardly to the dotted line position shown in FIG. 1, or they may be left projecting. If they are left projecting and if the forks 61 are then lowered again, the wings 98 will simply be pivoted upwardly by engagement with the frame members 14. As shown, the bottom outer corners of the wings 98 are rounded so as not to catch on the frame or rack teeth at this time.

Although the hooks 76 have been shown as engaging with the pallet 64 at a short distance above the ground, the position of the cam track 90 can be lowered or raised if desired. This can for example be accomplished by securing the cam track 90 to a tower channel 38, extending the hook cross shaft 74 laterally through a fork tine to a position adjacent the cam track, and by securing the cam follower support 86 to such protruding cross shaft so that it will engage the track 90 at the desired position. Thus the height at which the hooks engage the pallet can be adjusted if for example it is desired to discharge the contents of the pallet onto an elevated surface rather than onto the ground. Of course in such event, raised stops secured to the frame members 14 would be provided to block rearward movement of the gate 96 when the forks are at the height at which the pallet is to be discharged.

We claim:

1. A vehicle comprising:

(a) a pair of forks facing in a predetermined direction for supporting a pallet, (b) a frame, (c) a fork carriage, (d) means mounting said fork carriage on said frame for movement back and forth in said direction between an extended outer position and a retracted inner position, (e) means mounting said forks in said fork carriage and for raising and lowering said forks, (f) stop means mounted on said frame in a position such that when said forks are in said extended position a pallet supported thereon is located outwardly of said stop means and such that said forks may be withdrawn inwardly of said stop means, (g) a gate;

(h) and means for supporting said gate outwardly of said stop means and extending across said forks, so that when said gate is located between the contents of a pallet on said forks and said stop means and then said fork carriage is withdrawn inwardly, movement of said gate inwardly will be prevented by said stop means and said gate will act to discharge the contents of said pallet onto the ground, (i) said means (h) comprising:

(i) link means pivotally connected to said forks and to said gate and extensible between a first folded position in which said gate is supported by said link means over the rear of said forks and a second extended position in which said gate is supported by said link means over the fronts of said forks, (ii) and means biasing said link means to said first position, (j) said link means comprising: two pairs of links, each said pair having a first link pivotally connected to said forks and a second link pivotally connected to said gate, said first and second links each extending substantially vertically when said link means is in said first position, the upper ends of said first and second links being pivotally connected together, (k) said vehicle including a cross shaft connected between said forks at the rear thereof, said first links being fixed to said cross shaft, said biasing means including spring means within said cross shaft.

2. A vehicle comprising:

(a) a pair of forks facing in a predetermined direction for supporting a pallet, (b) a frame, (c) a fork carriage, (d) means mounting said fork carriage on said frame for movement back and forth in said direction between an extended outer position and a retracted inner position, (e) means mounting said forks in said fork carriage and for raising and lowering said forks, (f) stop means mounted on said frame in a position such that when said forks are in said extended position a pallet supported thereon is located outwardly of said stop means and such that said forks may be withdrawn inwardly of said stop means, (g) a gate;

(h) and means for supporting said gate outwardly of said stop means and extending across said forks, so that when said gate is located between the contents of a pallet on said forks and said stop means and then said fork carriage is withdrawn inwardly, movement of said gate inwardly will be prevented by said stop means and said gate will act to discharge the contents of said pallet onto the ground, (i) said means (h) comprising:

(i) link means pivotally connected to said forks and to said gate and extensible between a first folded position in which said gate is supported by said link means over the rear of said forks and a second extended position in which said gate is supported by said link means over the fronts of said forks, (ii) and means biasing said link means to said first position, (j) said vehicle further including hook means mounted on said forks and adapted to engage said pallet; means mounting said hook means for movement between a first position in which said hook means engage said pallet to prevent movement of said pallet off said forks, and a second position in which said hook means are disengaged from said pallet to permit movement of said pallet off said forks, and hook actuating means including cooperating cam and cam follower means mounted on said hook means and on said fork tower for moving said hook means to said first position when said forks are at a first height above the ground and for moving said hook means to said second position when said forks are at a second height above the ground, said first and second heights being different.

3. A vehicle according to claim 2 wherein said means for mounting said hook means comprises a cross shaft extending between said forks at the rear thereof and pivotally connected thereto; said hook means comprises a pair of hooks, one adjacent each side of said cross shaft, and extending forwardly therefrom toward the front of said forks, each hook having a barb at the front end thereof for engaging a cross member of said pallet, and a cam support member fixed to said cross shaft and extending rearwardly and upwardly therefrom, said cam and cam follower means comprising a cam follower roller mounted on said cam support member, and a cam track mounted on said fork tower.

4. A vehicle comprising: a pair of forks facing in a predetermined direction for supporting a loaded pallet, blocking means operable for blocking the contents of said pallet from moving in a second direction 180 degrees opposed to said predetermined direction, and means operable for withdrawing said pallet in said second direction while said contents thereof are blocked from moving in said second direction, thereby removing said pallet from beneath said contents and hence discharging said contents from said pallet, said blocking means comprising a gate, link means pivotally connected between said forks and said gate and extensible between a first folded position in which said gate is supported by said link means over the rear of said forks and a second extended position in which said gate is supported by said link means over the fronts of said forks, and means biasing said link means to said first position said link means comprising two pairs of links, each said pair having a first link pivotally connected to said forks and a second link pivotally connected to said gate, said first and second links each extending substantially vertically, when said link means is in said first position, the upper ends of said first and second links being pivotally connected together, said vehicle further including a cross shaft connected between said forks at the rear thereof, said first links being fixed to said cross shaft, said biasing means including spring means within said cross shaft.

* * * * *